US008109024B2

(12) United States Patent
Abst

(10) Patent No.: US 8,109,024 B2
(45) Date of Patent: Feb. 7, 2012

(54) TRIGGER ACTIVATED SWITCH

(76) Inventor: Terrill Abst, Oakdale, CA (US)

( * ) Notice: Subject to any disclaimer, the term of this patent is extended or adjusted under 35 U.S.C. 154(b) by 463 days.

(21) Appl. No.: 12/433,608

(22) Filed: Apr. 30, 2009

(65) Prior Publication Data

US 2010/0095574 A1 Apr. 22, 2010

Related U.S. Application Data

(60) Provisional application No. 61/106,604, filed on Oct. 19, 2008.

(51) Int. Cl.

| | |
|---|---|
| ***F41A 17/06*** | (2006.01) |
| ***F41A 35/00*** | (2006.01) |
| ***F41A 19/00*** | (2006.01) |
| ***F41C 27/00*** | (2006.01) |

(52) U.S. Cl. ..... 42/69.01; 42/117; 42/146; 124/31; 124/32

(58) Field of Classification Search ..... 42/69.01, 42/117, 146; 89/127, 136

See application file for complete search history.

(56) References Cited

U.S. PATENT DOCUMENTS

| | | | | |
|---|---|---|---|---|
| 2,593,117 | A | | 4/1952 | Davenport |
| 2,597,565 | A | | 5/1952 | Chandler et al. |
| 3,417,237 | A | | 12/1968 | Fenton |
| 3,785,261 | A | | 1/1974 | Ganteaume |
| 3,845,276 | A | | 10/1974 | Kendy et al. |
| 4,152,754 | A | * | 5/1979 | deFilippis et al. ..... 362/113 |
| 4,246,705 | A | | 1/1981 | Lee |
| 4,305,541 | A | | 12/1981 | Barrett et al. |
| 4,329,803 | A | | 5/1982 | Johnson et al. |
| 4,541,191 | A | | 9/1985 | Morris et al. |
| 4,630,911 | A | | 12/1986 | Paul |
| 4,777,864 | A | | 10/1988 | Siech et al. |
| 4,793,085 | A | * | 12/1988 | Surawski et al. ..... 42/84 |
| 4,907,022 | A | | 3/1990 | Myers |

(Continued)

FOREIGN PATENT DOCUMENTS

EP 276843 A2 * 8/1988

(Continued)

OTHER PUBLICATIONS

International Search Report and Written Opinion from counterpart PCT International Application No. PCT/US2009/060986, mailed Jun. 7, 2010.

*Primary Examiner* — Troy Chambers
(74) *Attorney, Agent, or Firm* — John P. O'Banion

(57) ABSTRACT

A trigger activated switch for a firearm is disclosed. The switch comprises a Hall-effect sensor configured to be mounted in the housing or frame of the firearm, and a magnet disposed on a retractable member coupled to the trigger of the gun. The trigger comprises a firing module rotatably coupled to the housing to have a range of motion with respect to the housing from a non-firing position to a firing position. The retractable member is moveably coupled to the firing module and articulates between a non-engaged position and engaged position with respect to the firing module. The Hall-effect sensor is attached to the firearm housing in proximity to the magnet when the retractable member is in the non-engaged position. Motion of the retractable member from the non-engaged position to the engaged position causes the magnet to articulate away from the sensor, which then activates an auxiliary device upon sensing motion of the retractable member.

25 Claims, 8 Drawing Sheets

U.S. PATENT DOCUMENTS

| | | | | |
|---|---|---|---|---|
| 5,119,576 | A | 6/1992 | Erning | |
| 5,421,264 | A * | 6/1995 | Petrick | 102/443 |
| 5,481,819 | A | 1/1996 | Teetzel | |
| 5,522,167 | A * | 6/1996 | Teetzel | 42/117 |
| 5,724,955 | A | 3/1998 | Johnson et al. | |
| 5,822,905 | A | 10/1998 | Teetzel | |
| 5,845,165 | A | 12/1998 | McMahon | |
| 5,965,835 | A | 10/1999 | Gartz | |
| 5,973,315 | A | 10/1999 | Saldana et al. | |
| 6,000,163 | A | 12/1999 | Gordon | |
| 6,142,137 | A | 11/2000 | MacLaughlin | |
| 6,425,697 | B1 | 7/2002 | Potts et al. | |
| 6,539,661 | B2 | 4/2003 | Hope | |
| 6,556,245 | B1 | 4/2003 | Holmbera | |
| 6,631,579 | B1 | 10/2003 | Lauster et al. | |
| 6,643,968 | B2 | 11/2003 | Glock | |
| 6,694,963 | B1 | 2/2004 | Taylor | |
| 6,748,938 | B2 | 6/2004 | Rice et al. | |
| 6,873,406 | B1 | 3/2005 | Hines et al. | |
| 6,886,287 | B1 | 5/2005 | Bell et al. | |
| 6,925,742 | B1 | 8/2005 | Van Zyl | |
| 6,973,748 | B2 * | 12/2005 | Rice | 42/69.01 |
| 7,121,036 | B1 | 10/2006 | Florence et al. | |
| 7,292,262 | B2 | 11/2007 | Towery et al. | |
| 7,421,816 | B2 * | 9/2008 | Conescu | 42/122 |
| 7,832,389 | B2 * | 11/2010 | Christopher | 124/51.1 |
| 7,900,622 | B2 * | 3/2011 | Douglas et al. | 124/73 |
| 7,921,835 | B2 * | 4/2011 | Campo et al. | 124/51.1 |
| 2003/0221684 | A1 * | 12/2003 | Rice | 124/71 |
| 2004/0200115 | A1 | 10/2004 | Monks et al. | |
| 2009/0025701 | A1 * | 1/2009 | Douglas et al. | 124/77 |

FOREIGN PATENT DOCUMENTS

| | | | |
|---|---|---|---|
| JP | 2006120466 | A * | 5/2006 |
| JP | 2006-526759 | A | 11/2006 |
| JP | 2006315119 | A * | 11/2006 |
| WO | WO 2004062077 | A2 * | 7/2004 |

* cited by examiner

TRIGGER ACTIVATED SWITCH

CROSS-REFERENCE TO RELATED APPLICATIONS

This application claims priority from U.S. provisional application Ser. No. 61/106,604 filed on Oct. 19, 2008, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to firearms, and more particularly to a laser activation switch for a firearm.

2. Description of Related Art

In present art guns, the mechanism for activating a laser or other attached electronic device typically involves pressing a button, sliding a switch, using a pressure pad type switch or other type of manual switch. Thus, an additional step is needed to activate a laser aiming device or other electronic device (e.g. a flashlight for illumination, or a video camera for recordkeeping, or the like). Particularly in moments of extreme duress, this extra step complicates and/or delays the act of shooting while potentially providing an adversary a momentary advantage.

It is generally accepted convention that the shooter is not to rest his/her finger on the trigger until they are ready to shoot the firearm. This is evidenced in Rule #2 of the NRA (National Rifle Association): "Always keep your finger off the trigger until ready to shoot. When holding a gun, rest your finger on the trigger guard or along the side of the gun. Until you are actually ready to fire, do not touch the trigger."

This "finger off the trigger until ready to shoot" convention is often misconstrued to mean that there must be no other function associated with trigger movement other than firing the gun. This logic would further extend to incorporating a switch into the trigger, as the general convention would prohibit touching the trigger to activate an auxiliary device because of possible negligent discharge. As such, current art devices all incorporate an auxiliary device from a location other than the trigger.

However, the above logic does not take into consideration that there is generally a primary laser switch attached to the laser itself that may be used for certain situations, and also neglects the need in other situations to have a quickly available laser in times of duress.

Therefore, it would be desirable to equip a firearm with multiple ways to activate the laser, to accommodate different scenarios where a soldier, law enforcement officer, or other needs to present his weapon.

For example, a first scenario is when there is a need to present the weapon and also enough time for the officer or soldier to deal with the situation by issuing orders to the suspect. The weapon is unholstered in order to "threat escalate". The weapon is not necessarily pointed at the subject. The weapon may be then pointed at the suspect in order to further "threat escalate". A laser pointer on the weapon may be activated (e.g. with the laser's primary switch) without touching the trigger in order to again "threat escalate". Ultimately the weapon may be discharged.

The second scenario is that there is an immediate deadly threat and the soldier or law enforcement officer needs to return fire without delay. The weapon is fired and the laser is thereby activated with the trigger switch allowing instant accurate point shooting. In this scenario, there is little or no chance that a laser can be activated when there is a need to deliver deadly force with no delay, no time to threat escalate, no time to think, no time to issue orders. Currently, there is no device available that addresses this need.

Accordingly, an object of the present invention is to provide an apparatus that automatically activates an auxiliary device, such as a laser, via the normal operation of the gun trigger.

BRIEF SUMMARY OF THE INVENTION

The present invention comprises a trigger activated switch to operate and one or more auxiliary electronic components such as a laser for a firearm. The switch comprises a sensor such as a Hall-effect sensor or the like, a sensor target such as a magnet, a transistor, a power supply, and associated wiring which is preferably embedded into the frame of the handgun.

The present invention is used to switch on or activate a laser or other attached electronic device without the need of pressing a button, sliding a switch, using a pressure pad type switch or any other type of manual switch.

An aspect of the invention is a firearm, comprising a trigger disposed within a housing, the trigger comprising a firing module mounted within the housing to have a range of motion with respect to the housing from a non-firing position to a firing position. The trigger comprises a retractable member coupled to the firing module, wherein the retractable member has a non-engaged position and engaged position with respect to the firing module. The retractable member is coupled to a first element. The housing comprises a sensor in proximity to the first element when the retractable member is in the non-engaged position. Motion of the retractable member from the non-engaged position to the engaged position causes the first element to articulate away from the sensor. The sensor is sensitive to motion of the first element with respect to the housing such that motion of the retractable member from the non-engaged position to the engaged position is sensed by the sensor, wherein the sensor activates an auxiliary device upon sensing motion of the retractable member.

In a preferred embodiment, wherein the first element comprises a magnet and the sensor comprises a Hall-effect sensor responsive a magnetic field of the magnet.

The trigger mechanism is configured such the firing module is able to remain stationary in the non-firing position while the auxiliary device is activated.

In a preferred embodiment, the auxiliary device comprises a laser. The auxiliary device may also comprise one or more of the following: flashlight, LED, or video camera or the like.

In another preferred embodiment, the sensor is embedded in the housing. The housing also preferably comprises a non-metallic substance, such as a polymer. The magnet may also be embedded in the retractable member.

In one embodiment, the retractable member comprises a safety that houses the magnet. The spur is located adjacent the sensor when the retractable member is in the non-engaged position such that the spur articulates away from the sensor when the retractable member moves toward the engaged position. Furthermore, the safety release may comprise a lower portion of the trigger. The safety release may be pivotably attached to the firing module such that the safety release is configured to rotate independently with respect to the firing module from the non-engaged position to the engaged position.

In another embodiment, the retractable member comprises a touch detection tab that is pivotally attached to the trigger and comprises a lower arm that is biased to extend from the inner gripping surface of the trigger when the retractable member is in the non-engaged position. The touch detection tab further comprises an upper arm that houses the magnet. The upper arm of the touch detection tab is adjacent or near the sensor when the retractable member is in the non-engaged position such that the upper arm of the touch detection tab articulates away from the sensor when the lower arm is articulated toward the trigger. The trigger may further have a recess extending into the inner gripping surface such that the lower arm of the touch detection tab is retracts at least partially into the recess when in the engaged position.

Another aspect is a trigger mechanism for a firearm. The trigger mechanism includes a trigger configured to be disposed within a firearm housing, wherein the trigger comprising a firing module configured to be rotatably coupled to the housing to have a range of motion with respect to the housing from a non-firing position to a firing position. The trigger has a retractable member movably coupled to the firing module from a non-engaged position and engaged position with respect to the firing module. The retractable member is coupled to a magnet, and a Hall-effect sensor is configured to be attached to the firearm housing in proximity to the magnet when the retractable member is in the non-engaged position. Motion of the retractable member from the non-engaged position to the engaged position causes the magnet to articulate away from the sensor, which is configured to activate an auxiliary device upon sensing motion of the retractable member.

Yet another aspect is a firearm or gun, comprising a trigger disposed within a firearm housing, a firing module rotatably coupled to the housing to have a range of motion with respect to the housing from a non-firing position to a firing position. The gun includes an auxiliary device, such a laser wherein the laser comprises a first switch configured to control actuation of said laser. The first switch is disposed on the gun at a location other than the trigger, and allows for activation of the laser when the shoot is not intending to immediately fire the gun. A second switch is provided having a retractable member moveably coupled to the firing module. The retractable member has a non-engaged position and engaged position with respect to the firing module, and is coupled to a magnet such that motion of the retractable member affects motion of the magnet. The second switch further comprises a Hall-effect sensor coupled to the firearm housing in proximity to the magnet when the retractable member is in the non-engaged position. Motion of the retractable member from the non-engaged position to the engaged position causes the magnet to articulate away from the sensor, which activates the laser upon sensing motion of the retractable member. The second switch is ideal for point shooting, or situations where the user is likely to fire the gun.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 12. It will be appreciated that the apparatus may vary as to configuration and as to details of the parts, and that the method may vary as to the specific steps and sequence, without departing from the basic concepts as disclosed herein.

Figure 1:
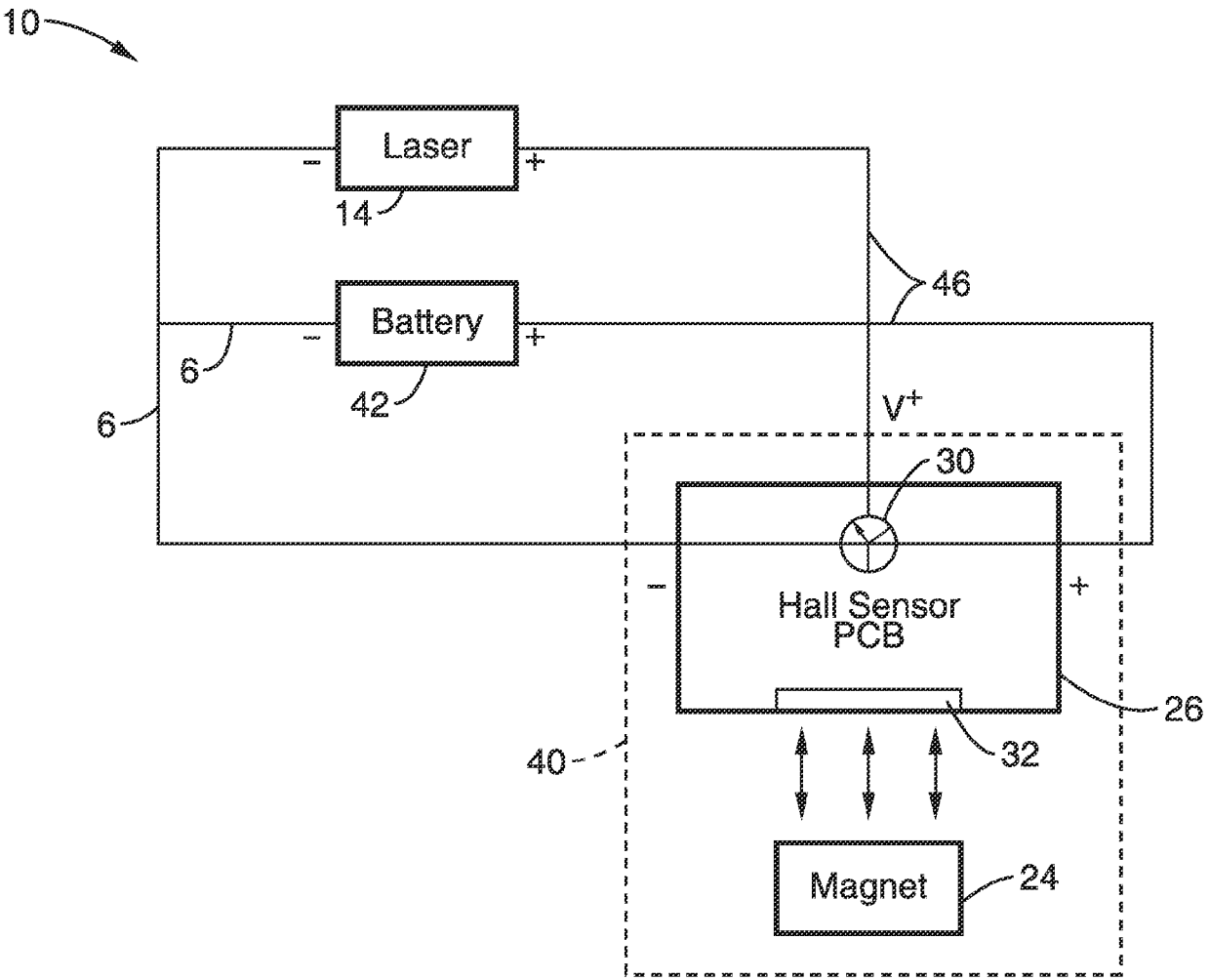
FIG. 1 is a schematic diagram of a trigger-activated switch in accordance with the present invention.
Figure 2:
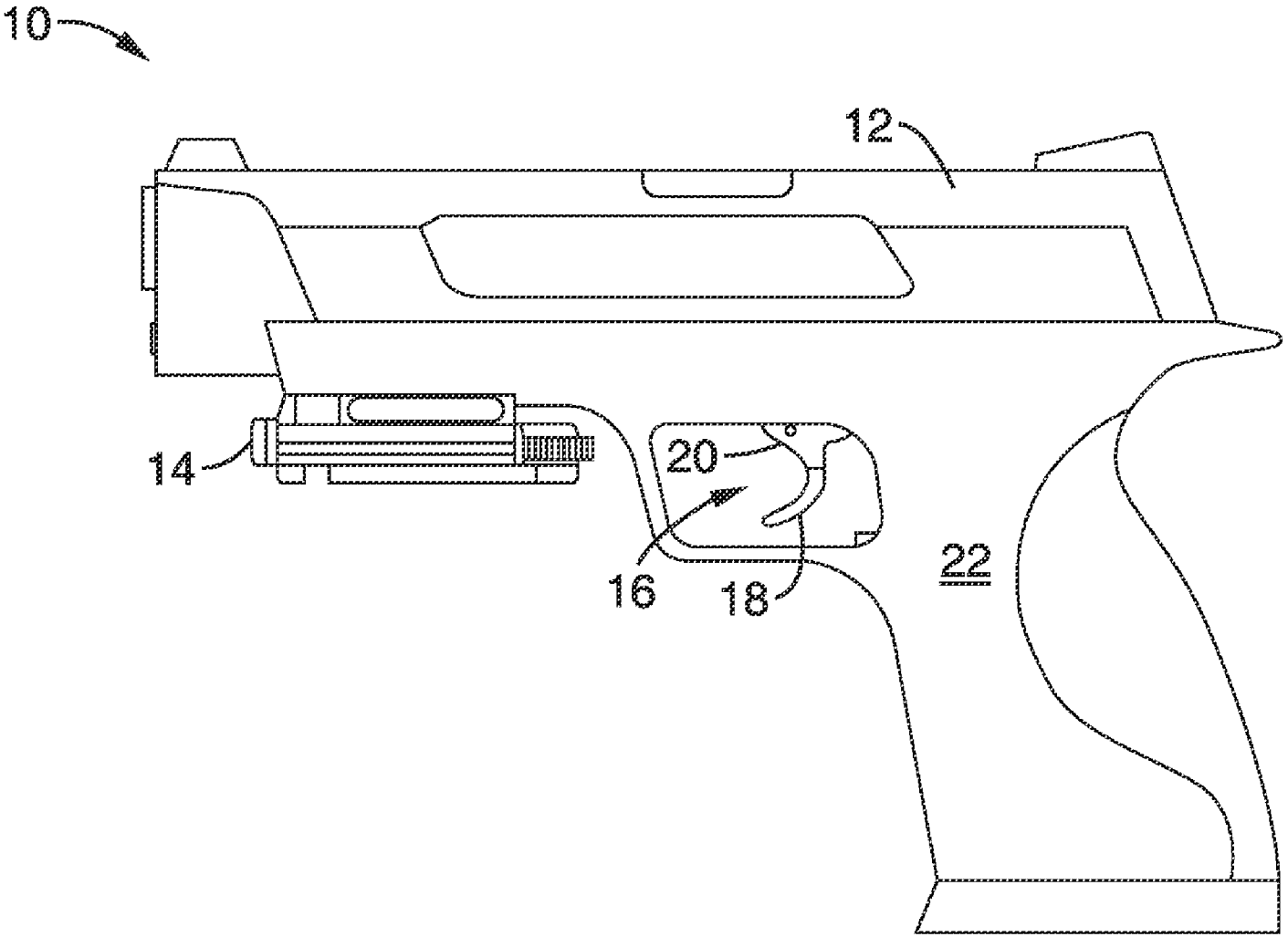
FIG. 2 shows a handgun with the trigger-activated switch of the present invention.

FIG. 1 illustrates a schematic diagram of a trigger-activated switch 10 in accordance with the present invention. The device comprises a sensor module 40 for sensing movement or motion of the gun trigger 16. The sensor module 40 comprises a Hall-effect printed circuit board (PCB) 26 having a Hall-effect sensor 32 that is responsive to a first element, e.g. magnet 24, embedded in the trigger 20. The sensor 32 is coupled to a transistor 30 on the PCB 26. The circuit board 26 is attached to or embedded into the polymer handgun frame 22 (FIG. 2). The sensor unit 26 preferably comprises a self-contained unit with circuit board, transistor and other circuitry such as, but not limited to, the Allegro A1172 Hall-effect switch provided be Allegro Microsystems, Inc.

It is appreciated that while the Hall-effect sensor is preferred for sensing motion of the first element, other sensing means available in the art may also be employed. For example, a pressure transducer may also be employed to detect motion of an element coupled to the trigger with respect to the housing 22.

The magnet 24 is attached to or embedded into a moving part of the trigger mechanism 20. The magnet 24 and sensor/transistor circuit board 26 are mounted in close proximity with respect to each other to maximize sensitivity of the sensor. The Hall-effect sensor 26 of the present invention acts as a transducer that converts magnetic energy to electrical energy for purposes of information transfer), in which the output voltage is varied in response to changes in magnetic field. With a predetermined magnetic field, its distance from a magnetic source (e.g. magnet 24) can be determined.

A power source 42 is connected to the PCB 26 and laser 14 via wiring 46. The power source 42 preferably comprises a portable battery or like source. The output of the PCB 26 connects to the aiming laser 14 (or other auxiliary device to be switched, e.g., flashlight, light emitting diode, microminiature video camera, a sound recording transducer, associated circuitry for recording and storing video images and sound, etc). Movement of the magnet 24 is sensed by sensor 32 (via the magnetic field produced from magnet 24), which switches transistor 30 to cause V+ to go from infinite resistance to almost zero resistance allowing the laser 14 to turn on with the completion of the circuit between the PCB 26, battery 42, and laser 14.

FIG. 2 illustrates an exemplary handgun 12 utilizing the system 10 of the present invention. Handgun 12 comprises a Smith and Wesson model M&P handgun with safety release trigger assembly 16. Trigger assembly 16 comprises a retractable member in the form of lower trigger release 18 that is rotatably coupled to upper firing module 20.

It is appreciated that the laser 14, or other auxiliary device, may have a primary switch (other than the trigger activated switch 10 of the present invention) that turns the laser 14 on or off. This switch may be located on the laser itself or on another location on the gun other than the trigger (e.g., in frame 22). This primary switch may be used in situations where the user is not intending to immediately fire the gun, e.g. illuminate a subject for a warning, etc. The trigger-activated switch 10 would then be preferably used for point shooting, particularly in situations of duress.

Figure 3:
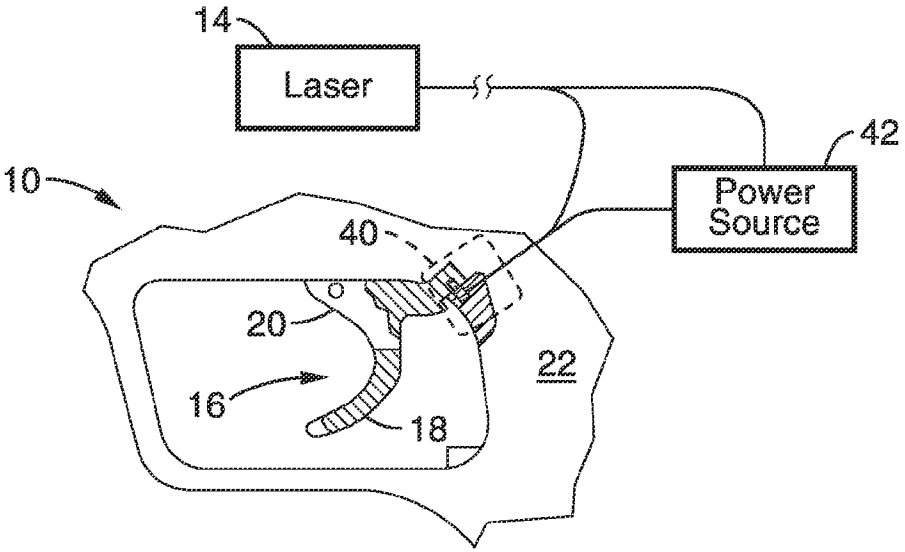
FIG. 3 is a detailed schematic view of the gun of FIG. 2.
Figure 4:
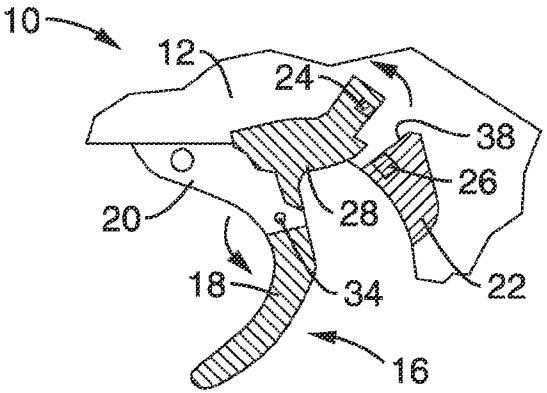
FIG. 4 is a detailed view of the gun of FIG. 2 with safety release engaged to activate the switch.
Figure 5:
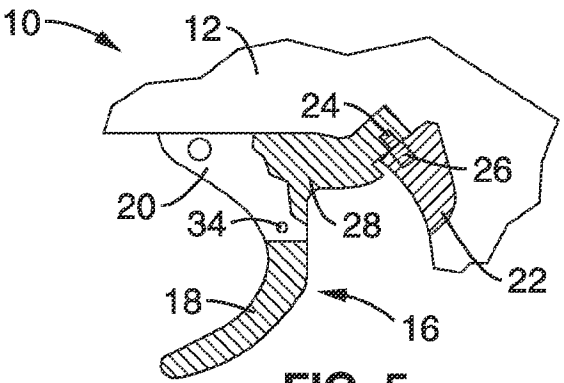
FIG. 5 is a view of the gun of FIG. 2 with safety release disengaged to deactivate the switch.

FIGS. 3-5 illustrate in more detail the trigger assembly 16 having a trigger safety release or retractable member 18 and upper firing module 20. Although a handgun is illustrated in FIGS. 3-5, it is appreciated that any gun (e.g. rifle, shotgun, etc.) may be equipped with the system 10 of the present invention. Additionally, the system 10 of the present invention may also be used with other systems utilizing triggers. The sensor 26 is embedded in the frame 22 very close to, or directly adjacent to, the magnet 24 embedded in the spur 28.

Referring to FIG. 4, as pressure is applied to the trigger assembly 16, the lower section (trigger safety release) 18 of trigger assembly 16 releases from its initial, non-engaged position and travels rearward toward the gun handle. The trigger safety release 18 rotates about pivot 34 such that the drop safety spur 28 (which is fixedly coupled to the safety release 18) rotates away from the frame 22 of the gun 12. Accordingly, the stop, which houses magnet 24, moves away from surface 38 of frame 22. This alters the magnetic field applied to the sensor 26, which then acts as a switch to power laser 14 by allowing current to flow from the battery 42 into the transistor 44, closing the circuit to the laser 14, and activating the laser 14.

Referring now to FIG. 5, upon firing and/or release of pressure applied to the trigger 18, the magnet 24 returns to its adjacent location against the sensor 26 (via biasing spring not shown), switching the laser 14 back to the off condition.

As shown above, the Hall-effect sensor 26 is the stationary element of assembly 40 embedded into the handgun frame 22 so as to be in a fixed position. The magnet is attached to or embedded into part of the trigger mechanism so that it is in very close proximity to the Hall-effect sensor circuit board.

A highly beneficial aspect of the present invention is that the gun's firing mechanism (defined by motion of trigger module 20), is not activated in any way as a result of the engagement of the laser 14 (or other auxiliary device). Thus, the act of touching the trigger 18 (with minimal applied force (e.g., less than a pound, and preferably less than an ounce)) is all that is needed to activate a laser-aiming device 14 or other electronic device installed on the gun 12. The upper trigger module 20, which generally takes a much larger amount of force (approximately 5-7 lbs) to initiate motion, is entirely stationary during activation of laser 14 via safety release 18.

The laser 14, or other electronic device, is activated only for that time that the finger is on the trigger 18 and is deactivated when the finger is removed from the trigger 18.

Figure 6:
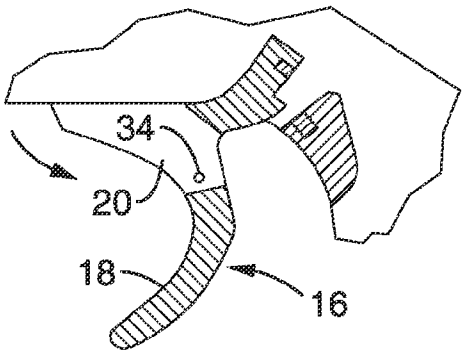
FIG. 6 is a view of the gun of FIG. 2 with the switch activated and the trigger engaged toward the firing position.

FIG. 6 illustrates actual activation of the gun's firing mechanism. Trigger firing module 20 comprises a forward non-firing position and a rearward firing position. With a significantly larger amount of pressure (approximately 5-7 lbs as opposed to less than 1 oz), the upper trigger module 20 begins to rotate in unison with the drop safety spur 28 from the non-firing position (at which it is biased) to the firing position to fire the gun. As explained above, the release of retractable member 18 and activation of laser 14 is achieved without motion of the firing module 20. The firing module 20 remains in the non-firing position until the user applies significant force to the handle, as illustrated in FIG. 6.

Figure 7:
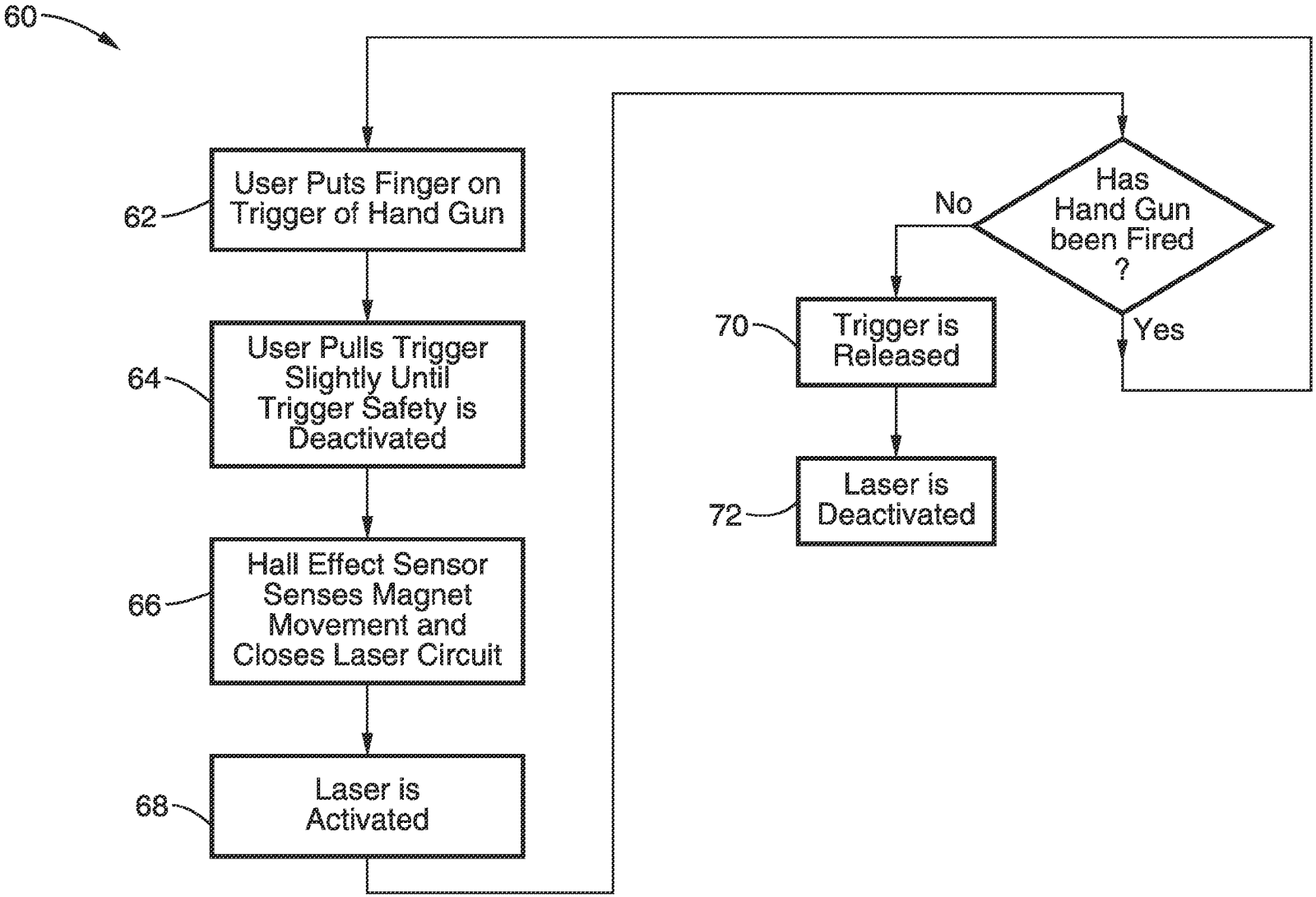
FIG. 7 is a flow diagram illustrating a method of activating a laser in accordance with the present invention.
Figure 9:
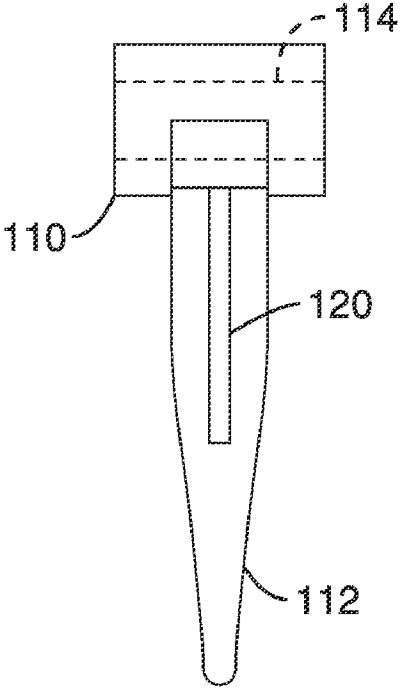
FIG. 9 is a front view of the trigger-activated switch of FIG. 8.
Figure 8:
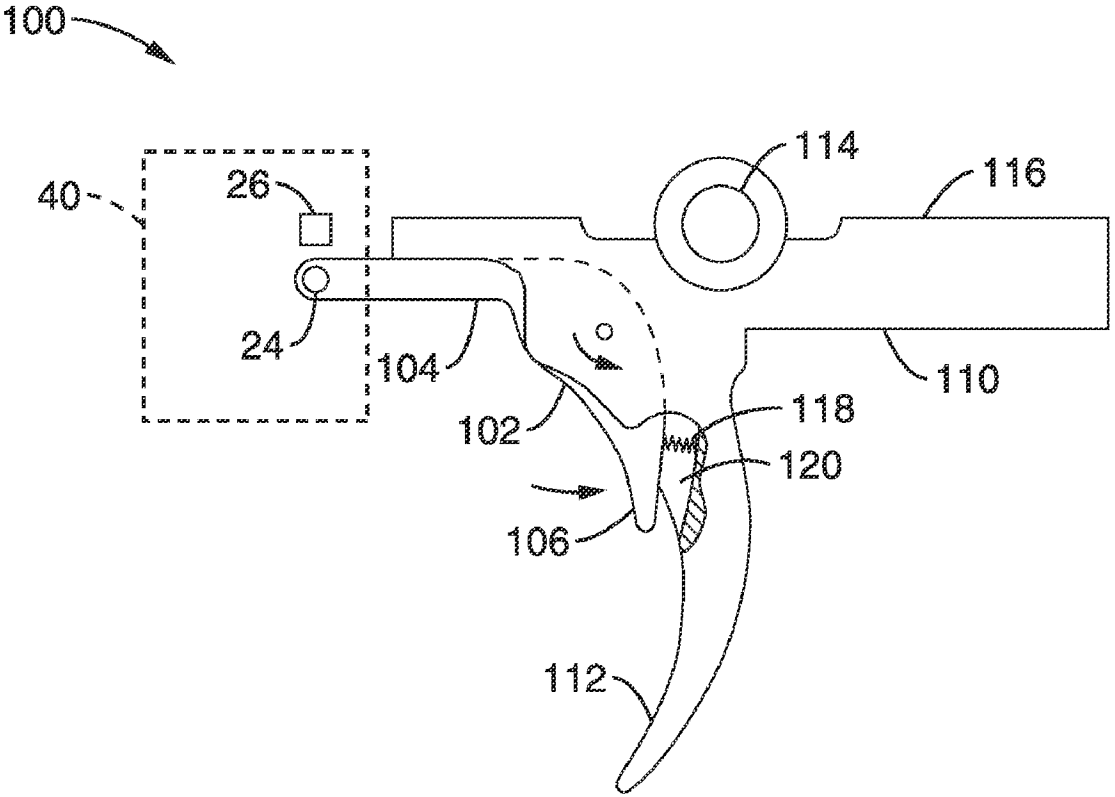
FIG. 8 is a side view of an alternative trigger activated switch incorporating a touch detection tab in accordance with the present invention.

The above described trigger-activated switch mechanism is further described in method 60 shown in FIG. 7. At step 62, the user puts his/her finger on the trigger 16 of the gun. At step 64, the user applies a very slight amount of pressure (e.g. 1 oz or less) to the trigger safety 18, deactivating the safety. The corresponding motion of the magnet 24 away from the sensor 26 is sensed by sensor 26, which closes the laser circuit at step 66. Power is then supplied to laser 14 (or other auxiliary device) to activate the laser at step 68. Up to this point, no motion of the firing mechanism (e.g. upper firing module 20) is required to activate the laser 14. If the user does not fire the gun and releases the trigger release 18 (step 70), the laser is deactivated (step 72). If the user fires the gun, and keeps the finger on the trigger release 18, the sequence repeats at step 62 to keep or maintain activation of the laser for site on the intended target.

Thus, the activation of auxiliary device 14 is seamless, relatively effortless and invisibly incorporated into the act of shooting the gun. No intermediate steps or additional actions need be performed to activate the aiming laser, as found with laser aiming devices. The present invention removes the additional step needed to activate a laser aiming device or other electronic device which, especially in moments of extreme duress, does not complicate the act of shooting while the shooter gains the advantage of automatically activating a laser for aiming, a flashlight for illumination, or a video camera for recordkeeping.

FIGS. 8-12 illustrate an alternative embodiment of a trigger-activated switch 100 in accordance with of the present invention. The trigger-activated switch 100 is illustrated in FIGS. 8-12 for use with a carbine-type gun. However, it is appreciated that the trigger-activated switch 100 may be incorporated into any number of different gun types.

Trigger-activated switch 100 includes a sensor module 40 comprising sensor PCB 26 opposite a magnet 24 located on upper arm 104 of touch detection tab 102. The touch detection tab 102 comprises a trigger-shaped tab that is pivotably mounted inside a recess or slot 120 (see FIGS. 8 and 9) of trigger body 110. The slot 120 runs vertically down an inside portion of the length of trigger portion 112. Touch detection tab 102 comprises a hinge 108 disposed a lower arm 106 and magnet arm 104. The lower arm 106 of touch detection tab 102 is biased with spring 118 to extend outward from slot 120 so that it protrudes from the inner, or gripping, surface of trigger portion 112.

Figure 10:
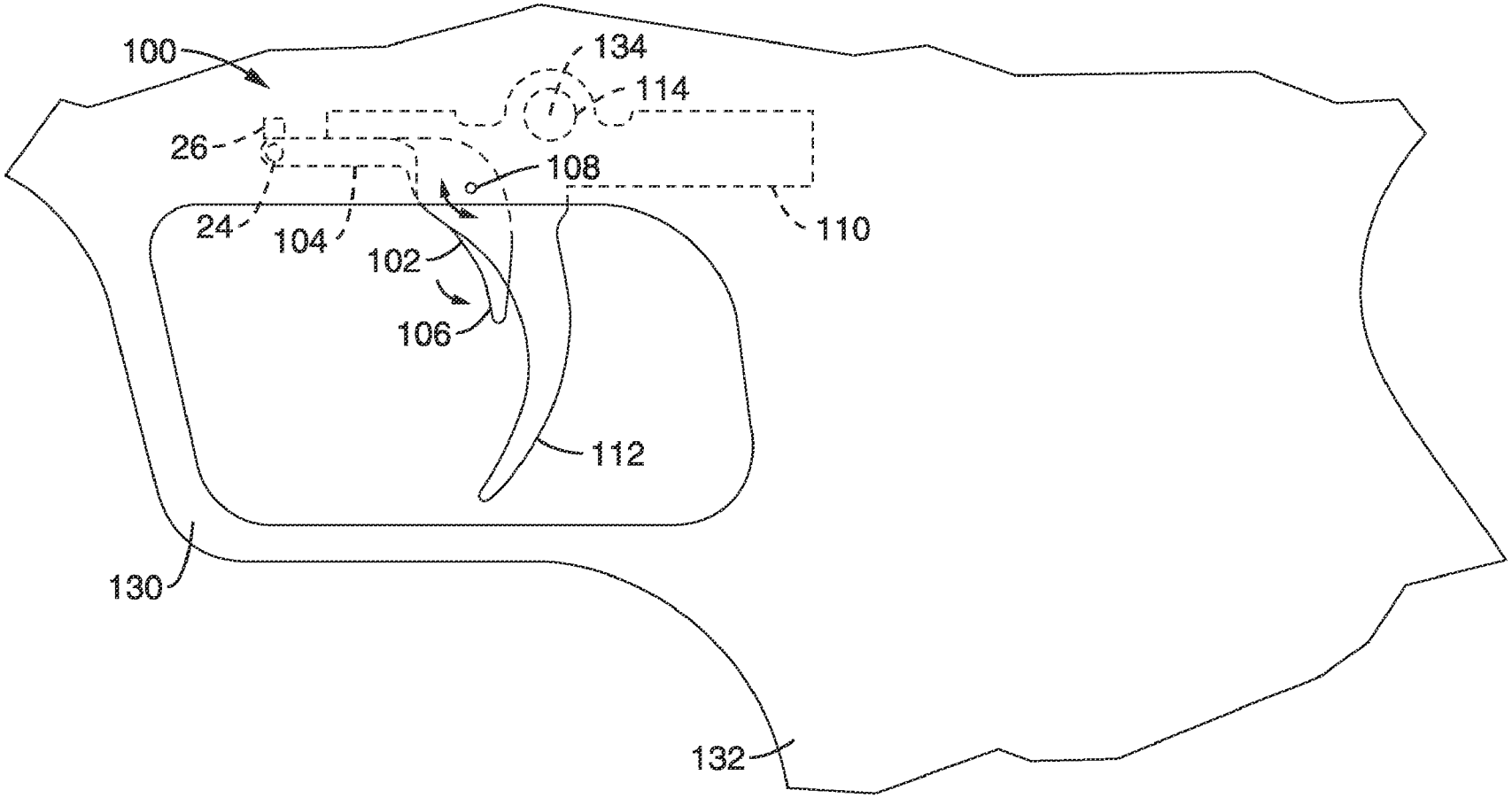
FIG. 10 is detailed view of the trigger-activated switch of FIG. 8 installed in a carbine gun.

As shown in FIG. 10, the trigger body 110 is pivotally mounted to gun frame 130 via a hinge 134 in bore 114. FIG. 10 illustrates the trigger body 110 in the non-engaged configuration with the sensor PCB 26 is mounted to the frame 130 so that it lines up adjacent to or near magnet 24. The trigger body 110 is the firing module for the gun, and activation of the firing module (i.e., pulling the trigger) is the sole mechanism for firing the gun.

Figure 11:
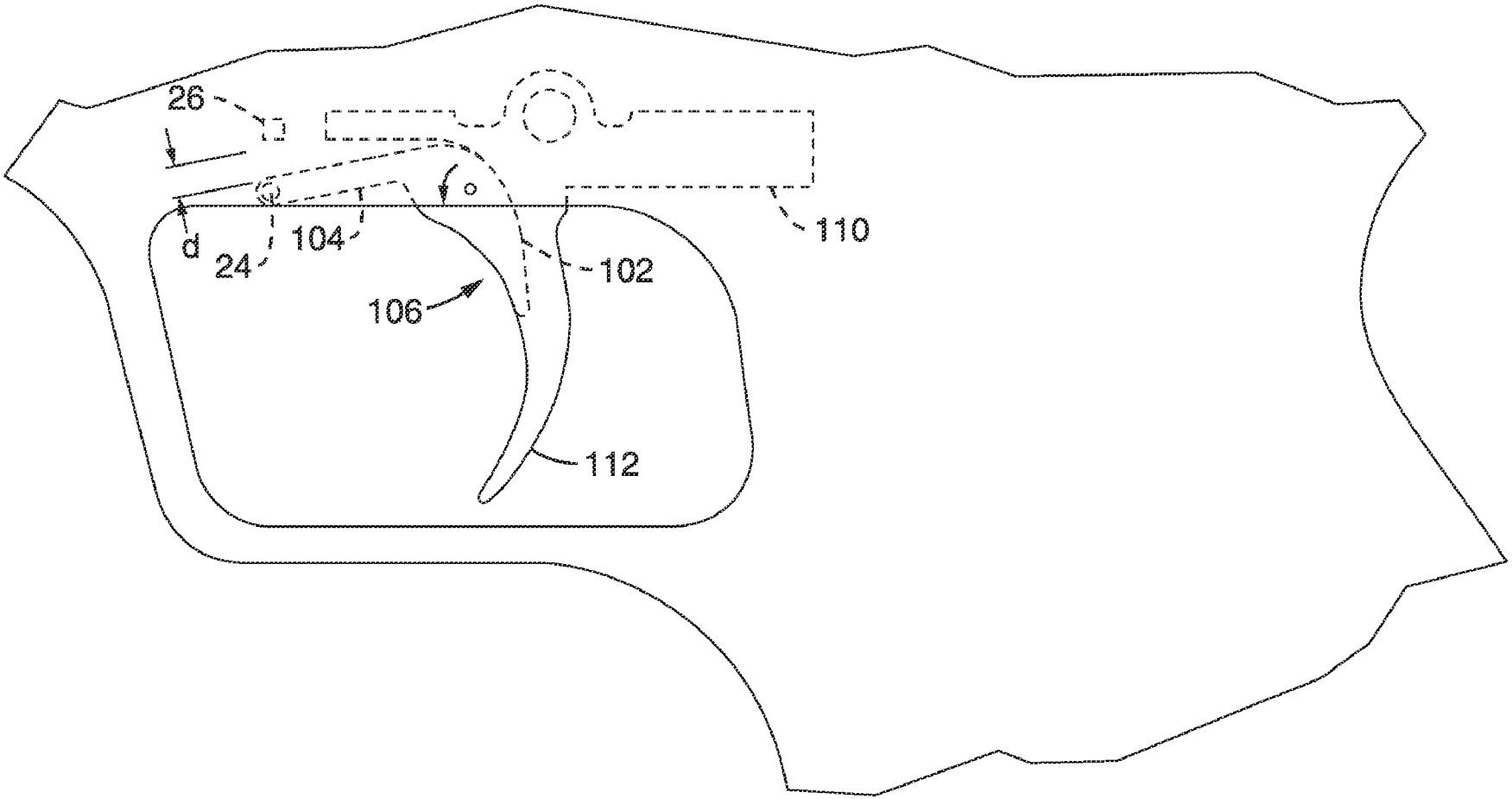
FIG. 11 is a view of the gun of FIG. 10 with the trigger-activated switch engaged.

Referring now to FIG. 11, when a user grasps handle 132 and positions his/her finger on trigger portion (firing module) 112, the lower portion 106 of touch detection tab 102 retracts at least partially within trigger 112. Spring 118 may bias the tab 102 with a minimal amount of force, so that the slightest pressure applied to the tab 102 (e.g., an amount (e.g., 1 ounce) significantly less than the pressure required to pull, or even initiate motion of, the upper portion 112) retracts the tab trigger portion 106 at least partially into slot 120. As trigger portion 106 retracts inward, the upper arm 104 rotates downward about pivot 108. The movement of upper arm 104 causes separation (distance d) between the stationary sensor 26 and the magnet 24. This separation changes the magnetic field sensed by the sensor 26, which then activates the auxiliary device 14. If the person's finger is released from the trigger 112, the biasing spring 118 forces the lower trigger portion 106 of tab 102 to its initial orientation, returning the magnet 24 in proximity to sensor 26 and deactivating the laser 14.

Figure 12:
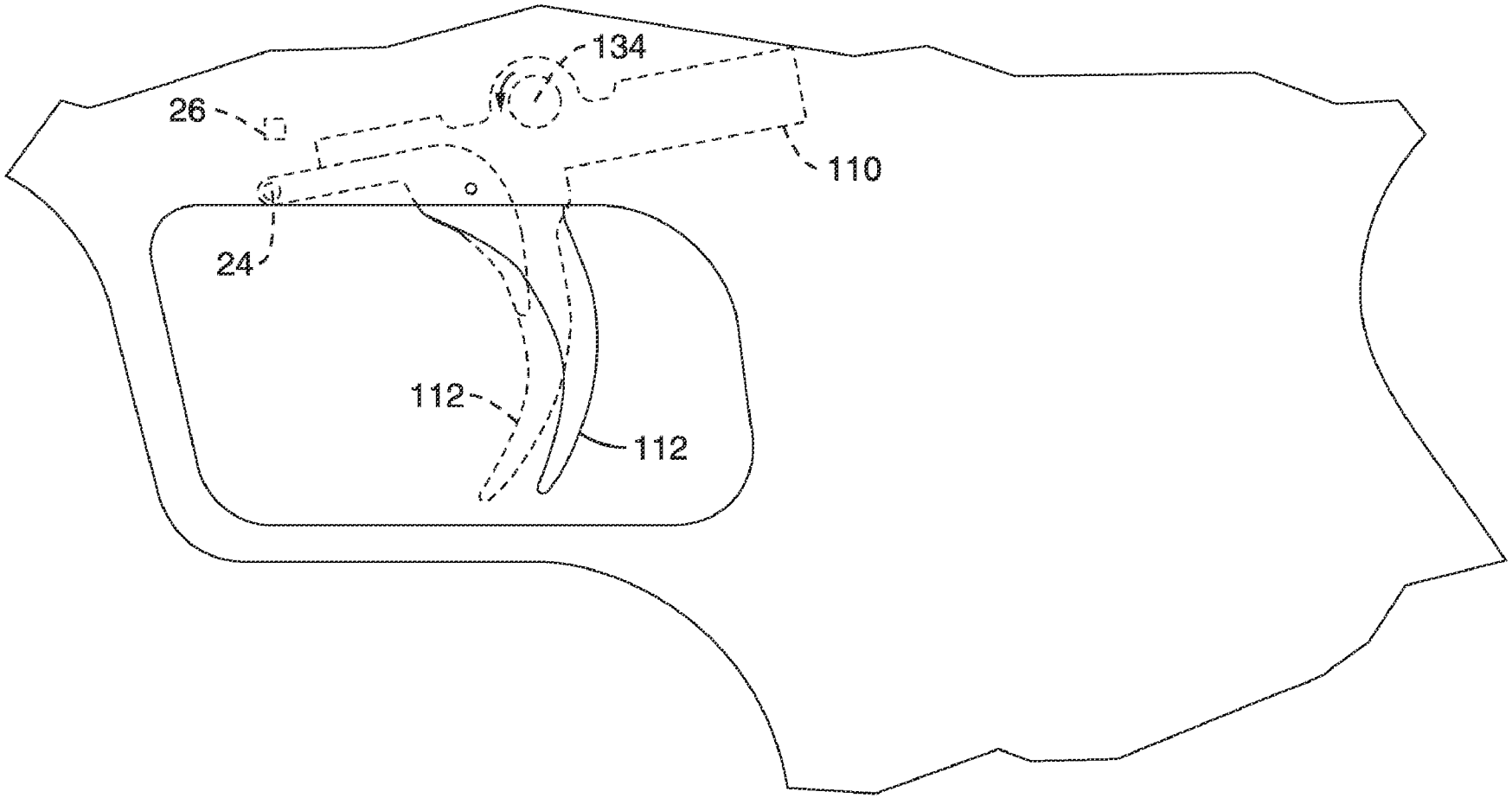
FIG. 12 is a view of the gun of FIG. 10 with the trigger-activated switch engaged and the trigger engaged toward the firing position.

FIG. 12 illustrates motion of the trigger 112 from its initial, non-firing orientation (shown in phantom) to a position toward engagement of the firing mechanism. As the trigger body 110 rotates about pin 134, the touch detection tab moves with it, furthering the distance between the magnet 24 and sensor 26, and thus the laser 14 remains engaged.

The frame 22 in FIGS. 2-6 and frame 130 in FIGS. 10-12 preferably comprise a polymeric material that facilitates mounting of electronics. The sensor PCB 26 and wiring 46 are preferably embedded in the polymer. The electrical insulating properties of polymer plastic allows the embedding of wiring, electronic sensors, batteries, (and other devices such as light emitting diodes, video cameras and other components) without the inherent problems associated with adding electrical components and circuitry onto or into electrically conductive metal framed handguns or other firearms. In addition, the polymer plastic is non-magnetic so micro-miniature magnetic sensors can easily detect very small movements of trigger components for switch activation.

Polymer plastic is easily machined for the creation of cavities and/or channels for insertion of wires and components (e.g. PCB sensor 26). Backfilling the residual channels and cavities permanently covers the wires and electrical components so there is little chance of exposure and subsequent damage of fragile circuitry or components. The wiring and components may be manufactured into the gun frame (22, 130) mold prior to the injection mold process and embed electrical circuitry and components directly into the polymer frame.

As can be seen, therefore, the present invention includes the following inventive embodiments, among others:

1. A firearm, comprising:

a trigger disposed within a housing;

said trigger comprising a firing module mounted within the housing to have a range of motion with respect to the housing from a non-firing position to a firing position;

the trigger comprising a retractable member coupled to the firing module;

the retractable member comprising a non-engaged position and engaged position with respect to the firing module;

the retractable member being coupled to a first element;

wherein the housing comprises a sensor in proximity to the first element when the retractable member is in the non-engaged position;

wherein motion of the retractable member from the non-engaged position to the engaged position causes the first element to articulate away from the sensor;

wherein the sensor is sensitive to motion of the first element with respect to the housing such that motion of the retractable member from the non-engaged position to the engaged position is sensed by the sensor; and an auxiliary device coupled to the housing;

wherein the sensor is configured to activate said auxiliary device upon sensing motion of the retractable member.

2. A firearm as recited in embodiment 1:

wherein the first element comprises a magnet; and wherein the sensor comprises a Hall-effect sensor responsive a magnetic field of the magnet.

3. A firearm as recited in embodiment 2, wherein the firing module remains in the non-firing position while the auxiliary device is activated.

4. A firearm as recited in embodiment 3, wherein the auxiliary device comprises a laser.

5. A firearm as recited in embodiment 3, wherein the auxiliary device comprises one of the following: flashlight, LED, or video camera.

6. A firearm as recited in embodiment 1, wherein the sensor is embedded in the housing.

7. A firearm as recited in embodiment 6, wherein the housing comprises a non-metallic substance.

8. A firearm as recited in embodiment 7, wherein the housing comprises a polymer.

9. A firearm as recited in embodiment 6, wherein the magnet is embedded in the trigger.

10. A firearm as recited in embodiment 3:

wherein the retractable member comprises a safety release pivotably coupled to the firing module;

wherein the safety release comprises a spur housing the magnet;

wherein the spur is located adjacent the sensor when the retractable member is in the non-engaged position; and wherein the spur articulates away from the sensor when the retractable member moves toward the engaged position.

11. A firearm as recited in embodiment 10:

wherein the safety release comprises a lower portion of the trigger; and wherein the safety release is pivotably attached to the firing module such that the safety release is configured to rotate independently with respect to the firing module from the non-engaged position to the engaged position.

12. A firearm as recited in embodiment 3:

wherein the trigger comprises an inner gripping surface;

wherein the retractable member comprises a touch detection tab;

wherein the touch detection tab is pivotally attached to the trigger and comprises a lower arm that is biased to extend from the inner gripping surface when the retractable member is in the non-engaged position;

wherein the touch detection tab further comprises an upper arm, the upper arm housing the magnet;

wherein the upper arm of the touch detection tab is adjacent or near the sensor when the retractable member is in the non-engaged position; and wherein the upper arm of the touch detection tab articulates away from the sensor when the lower arm is articulated toward the trigger.

13. A firearm as recited in embodiment 12:

wherein the trigger comprises a recess extending into the inner gripping surface; and wherein the lower arm of the touch detection tab is retracts at least partially into said recess in the engaged position.

14. A trigger mechanism for a firearm, comprising:

a trigger configured to be disposed within a firearm housing;

said trigger comprising a firing module configured to be rotatably coupled to the housing to have a range of motion with respect to the housing from a non-firing position to a firing position;

the trigger comprising a retractable member coupled to the firing module;

the retractable member comprising a non-engaged position and engaged position with respect to the firing module;

the retractable member being coupled to a magnet;

a Hall-effect sensor configured to be attached to the firearm housing in proximity to the magnet when the retractable member is in the non-engaged position;

wherein motion of the retractable member from the non-engaged position to the engaged position causes the magnet to articulate away from the sensor;

wherein the sensor is sensitive to motion of the magnet with respect to the housing such that motion of the retractable member from the non-engaged position to the engaged position is sensed by the sensor; and wherein the sensor is configured to activate an auxiliary device upon sensing motion of the retractable member.

15. A trigger mechanism as recited in embodiment 14, wherein the firing module remains in the non-firing position while the auxiliary device is activated.

16. A trigger mechanism as recited in embodiment 15, wherein the auxiliary device comprises a laser.

17. A trigger mechanism as recited in embodiment 15:

wherein the retractable member comprises a safety release pivotably coupled to the firing module;

wherein the safety release comprises a spur housing the magnet;

wherein the spur is located adjacent the sensor when the retractable member is in the non-engaged position; and wherein the spur articulates away from the sensor when the retractable member moves toward the engaged position.

18. A trigger mechanism as recited in embodiment 17:

wherein the safety release comprises a lower portion of the trigger; and wherein the safety release is pivotably attached to the firing module such that the safety release is configured to rotate independently with respect to the firing module from the non-engaged position to the engaged position.

19. A trigger mechanism as recited in embodiment 14:

wherein the trigger comprises an inner gripping surface;

wherein the retractable member comprises a touch detection tab;

wherein the touch detection tab is pivotally attached to the trigger and comprises a lower arm that is biased to extend from the inner gripping surface when the retractable member is in the non-engaged position;

wherein the touch detection tab further comprises an upper arm, the upper arm housing the magnet;

wherein the upper arm of the touch detection tab is adjacent or near the sensor when the retractable member is in the non-engaged position; and wherein the upper arm of the touch detection tab articulates away from the sensor when the lower arm is articulated toward the trigger.

20. A trigger mechanism as recited in embodiment 19:

wherein the trigger comprises a recess extending into the inner gripping surface;

wherein the lower arm of the touch detection tab is retracts at least partially into said recess in the engaged position.

21. A firearm, comprising:

a trigger disposed within a firearm housing;

said trigger comprising a firing module rotatably coupled to the housing to have a range of motion with respect to the housing from a non-firing position to a firing position;

a laser;

the laser comprising a first switch configured to control actuation of said laser;

the first switch being disposed on the gun at a location other than the trigger;

a second switch configured to control actuation of said laser;

the second switch comprising a retractable member moveably coupled to the firing module;

the retractable member comprising a non-engaged position and engaged position with respect to the firing module;

wherein the retractable member is coupled to a magnet such that motion of the retractable member affects motion of the magnet;

the second switch further comprising a Hall-effect sensor coupled to the firearm housing in proximity to the magnet when the retractable member is in the non-engaged position;

wherein motion of the retractable member from the non-engaged position to the engaged position causes the magnet to articulate away from the sensor;

wherein the sensor is sensitive to motion of the magnet with respect to the housing such that motion of the retractable member from the non-engaged position to the engaged position is sensed by the sensor; and wherein the sensor is configured to activate the laser upon sensing motion of the retractable member.

22. A firearm as recited in embodiment 21:

wherein the retractable member comprises a safety release pivotably coupled to the firing module;

wherein the safety release comprises a spur housing the magnet;

wherein the spur is located adjacent the sensor when the retractable member is in the non-engaged position; and wherein the spur articulates away from the sensor when the retractable member moves toward the engaged position.

23. A firearm as recited in embodiment 22:

wherein the safety release comprises a lower portion of the trigger; and wherein the safety release is pivotably attached to the firing module such that the safety release is configured to rotate independently with respect to the firing module from the non-engaged position to the engaged position.

24. A firearm as recited in embodiment 21:

wherein the trigger comprises an inner gripping surface;

wherein the retractable member comprises a touch detection tab;

wherein the touch detection tab is pivotally attached to the trigger and comprises a lower arm that is biased to extend from the inner gripping surface when the retractable member is in the non-engaged position;

wherein the touch detection tab further comprises an upper arm, the upper arm housing the magnet;

wherein the upper arm of the touch detection tab is adjacent or near the sensor when the retractable member is in the non-engaged position; and wherein the upper arm of the touch detection tab articulates away from the sensor when the lower arm is articulated toward the trigger.

25. A firearm as recited in embodiment 24:

wherein the trigger comprises a recess extending into the inner gripping surface; and wherein the lower arm of the touch detection tab is retracts at least partially into said recess in the engaged position.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A firearm, comprising:

a trigger disposed within a housing;

said trigger comprising a firing module mounted within the housing to have a range of motion with respect to the housing from a non-firing position to a firing position;

the trigger comprising a retractable member coupled to the firing module;

the retractable member comprising a non-engaged position and engaged position with respect to the firing module;

the retractable member being coupled to a first element;

wherein the housing comprises a sensor in proximity to the first element when the retractable member is in the non-engaged position;

wherein motion of the retractable member from the non-engaged position to the engaged position causes the first element to articulate away from the sensor;

wherein the sensor is sensitive to motion of the first element with respect to the housing such that motion of the retractable member from the non-engaged position to the engaged position is sensed by the sensor; and an auxiliary device coupled to the housing;

wherein the sensor is configured to activate said auxiliary device upon sensing motion of the retractable member.

2. A firearm as recited in claim 1:

wherein the first element comprises a magnet; and wherein the sensor comprises a Hall-effect sensor responsive a magnetic field of the magnet.

3. A firearm as recited in claim 2, wherein the firing module remains in the non-firing position while the auxiliary device is activated.

4. A firearm as recited in claim 3, wherein the auxiliary device comprises a laser.

5. A firearm as recited in claim 3, wherein the auxiliary device comprises one of the following: flashlight, LED, or video camera.

6. A firearm as recited in claim 3:

wherein the retractable member comprises a safety release pivotably coupled to the firing module;

wherein the safety release comprises a spur housing the magnet;

wherein the spur is located adjacent the sensor when the retractable member is in the non-engaged position; and wherein the spur articulates away from the sensor when the retractable member moves toward the engaged position.

7. A firearm as recited in claim 6:

wherein the safety release comprises a lower portion of the trigger; and wherein the safety release is pivotably attached to the firing module such that the safety release is configured to rotate independently with respect to the firing module from the non-engaged position to the engaged position.

8. A firearm as recited in claim 3:

wherein the trigger comprises an inner gripping surface;

wherein the retractable member comprises a touch detection tab;

wherein the touch detection tab is pivotally attached to the trigger and comprises a lower arm that is biased to extend from the inner gripping surface when the retractable member is in the non-engaged position;

wherein the touch detection tab further comprises an upper arm, the upper arm housing the magnet;

wherein the upper arm of the touch detection tab is adjacent or near the sensor when the retractable member is in the non-engaged position; and wherein the upper arm of the touch detection tab articulates away from the sensor when the lower arm is articulated toward the trigger.

9. A firearm as recited in claim 8:

wherein the trigger comprises a recess extending into the inner gripping surface; and wherein the lower arm of the touch detection tab is retracts at least partially into said recess in the engaged position.

10. A firearm as recited in claim 1, wherein the sensor is embedded in the housing.

11. A firearm as recited in claim 10, wherein the housing comprises a non-metallic substance.

12. A firearm as recited in claim 11, wherein the housing comprises a polymer.

13. A firearm as recited in claim 10, wherein the magnet is embedded in the trigger.

14. A trigger mechanism for a firearm, comprising:

a trigger configured to be disposed within a firearm housing;

said trigger comprising a firing module configured to be rotatably coupled to the housing to have a range of motion with respect to the housing from a non-firing position to a firing position;

the trigger comprising a retractable member coupled to the firing module;

the retractable member comprising a non-engaged position and engaged position with respect to the firing module;

the retractable member being coupled to a magnet;

a Hall-effect sensor configured to be attached to the firearm housing in proximity to the magnet when the retractable member is in the non-engaged position;

wherein motion of the retractable member from the non-engaged position to the engaged position causes the magnet to articulate away from the sensor;

wherein the sensor is sensitive to motion of the magnet with respect to the housing such that motion of the retractable member from the non-engaged position to the engaged position is sensed by the sensor; and wherein the sensor is configured to activate an auxiliary device upon sensing motion of the retractable member.

15. A trigger mechanism as recited in claim 14, wherein the firing module remains in the non-firing position while the auxiliary device is activated.

16. A trigger mechanism as recited in claim 15, wherein the auxiliary device comprises a laser.

17. A trigger mechanism as recited in claim 15:

wherein the retractable member comprises a safety release pivotably coupled to the firing module;

wherein the safety release comprises a spur housing the magnet;

wherein the spur is located adjacent the sensor when the retractable member is in the non-engaged position; and wherein the spur articulates away from the sensor when the retractable member moves toward the engaged position.

18. A trigger mechanism as recited in claim 17:

wherein the safety release comprises a lower portion of the trigger; and wherein the safety release is pivotably attached to the firing module such that the safety release is configured to rotate independently with respect to the firing module from the non-engaged position to the engaged position.

19. A trigger mechanism as recited in claim 14:

wherein the trigger comprises an inner gripping surface;

wherein the retractable member comprises a touch detection tab;

wherein the touch detection tab is pivotally attached to the trigger and comprises a lower arm that is biased to extend from the inner gripping surface when the retractable member is in the non-engaged position;

wherein the touch detection tab further comprises an upper arm, the upper arm housing the magnet;

wherein the upper arm of the touch detection tab is adjacent or near the sensor when the retractable member is in the non-engaged position; and wherein the upper arm of the touch detection tab articulates away from the sensor when the lower arm is articulated toward the trigger.

20. A trigger mechanism as recited in claim 19:

wherein the trigger comprises a recess extending into the inner gripping surface;

wherein the lower arm of the touch detection tab is retracts at least partially into said recess in the engaged position.

21. A firearm, comprising:

a trigger disposed within a firearm housing;

said trigger comprising a firing module rotatably coupled to the housing to have a range of motion with respect to the housing from a non-firing position to a firing position;

a laser;

the laser comprising a first switch configured to control actuation of said laser;

the first switch being disposed on the gun at a location other than the trigger;

a second switch configured to control actuation of said laser;

the second switch comprising a retractable member moveably coupled to the firing module;

the retractable member comprising a non-engaged position and engaged position with respect to the firing module;

wherein the retractable member is coupled to a magnet such that motion of the retractable member affects motion of the magnet;

the second switch further comprising a Hall-effect sensor coupled to the firearm housing in proximity to the magnet when the retractable member is in the non-engaged position;

wherein motion of the retractable member from the non-engaged position to the engaged position causes the magnet to articulate away from the sensor;

wherein the sensor is sensitive to motion of the magnet with respect to the housing such that motion of the retractable member from the non-engaged position to the engaged position is sensed by the sensor; and wherein the sensor is configured to activate the laser upon sensing motion of the retractable member.

22. A firearm as recited in claim 21:

wherein the retractable member comprises a safety release pivotably coupled to the firing module;

wherein the safety release comprises a spur housing the magnet;

wherein the spur is located adjacent the sensor when the retractable member is in the non-engaged position; and wherein the spur articulates away from the sensor when the retractable member moves toward the engaged position.

23. A firearm as recited in claim 22:

wherein the safety release comprises a lower portion of the trigger; and wherein the safety release is pivotably attached to the firing module such that the safety release is configured to rotate independently with respect to the firing module from the non-engaged position to the engaged position.

24. A firearm as recited in claim 21:

wherein the trigger comprises an inner gripping surface;

wherein the retractable member comprises a touch detection tab;

wherein the touch detection tab is pivotally attached to the trigger and comprises a lower arm that is biased to extend from the inner gripping surface when the retractable member is in the non-engaged position;

wherein the touch detection tab further comprises an upper arm, the upper arm housing the magnet;

wherein the upper arm of the touch detection tab is adjacent or near the sensor when the retractable member is in the non-engaged position; and wherein the upper arm of the touch detection tab articulates away from the sensor when the lower arm is articulated toward the trigger.

25. A firearm as recited in claim 24:

wherein the trigger comprises a recess extending into the inner gripping surface; and wherein the lower arm of the touch detection tab is retracts at least partially into said recess in the engaged position.

* * * * *